US011186115B2

(12) United States Patent
Arminak

(10) Patent No.: US 11,186,115 B2
(45) **Date of Patent: *Nov. 30, 2021**

(54) ONE-HAND OPERATED MULTI-PENCIL

(71) Applicant: Armin Arminak, Pasadena, CA (US)

(72) Inventor: Armin Arminak, Pasadena, CA (US)

( * ) Notice: Subject to any disclaimer, the term of this patent is extended or adjusted under 35 U.S.C. 154(b) by 41 days.

This patent is subject to a terminal disclaimer.

(21) Appl. No.: 16/787,946

(22) Filed: Feb. 11, 2020

(65) Prior Publication Data

US 2020/0247174 A1 Aug. 6, 2020

Related U.S. Application Data

(63) Continuation-in-part of application No. 16/430,010, filed on Jun. 3, 2019, now Pat. No. 10,618,343.

(60) Provisional application No. 62/792,629, filed on Jan. 15, 2019.

(51) Int. Cl.

| | |
|---|---|
| ***B43K 27/04*** | (2006.01) |
| ***B43K 24/16*** | (2006.01) |
| ***B43K 27/00*** | (2006.01) |
| ***B43K 24/12*** | (2006.01) |
| ***B43K 27/02*** | (2006.01) |
| ***B43K 24/10*** | (2006.01) |

(52) U.S. Cl.

CPC ..... *B43K 27/04* (2013.01); *B43K 24/10* (2013.01); *B43K 24/12* (2013.01); *B43K 24/163* (2013.01); *B43K 27/006* (2013.01); *B43K 27/02* (2013.01)

(58) Field of Classification Search

CPC ..... B43K 27/006; B43K 27/02; B43K 27/04; B43K 24/10; B43K 24/12; B43K 21/006; B43K 21/06; B43K 21/16

USPC ..... 401/31

See application file for complete search history.

(56) References Cited

U.S. PATENT DOCUMENTS

| | | | |
|---|---|---|---|
| 6,217,241 | B1 | 4/2001 | Kobayashi |
| 7,008,131 | B2 | 3/2006 | Kagevarna et al. |
| 7,946,777 | B2 | 5/2011 | Yamauchi et al. |
| 9,738,113 | B2 | 8/2017 | Tani |
| 10,076,925 | B2 | 9/2018 | Tani |
| 2008/0038486 | A1 | 2/2008 | Cook |

(Continued)

FOREIGN PATENT DOCUMENTS

| | | | |
|---|---|---|---|
| CN | 105270036 | A | 1/2016 |
| GB | 805835 | A | 12/1958 |
| WO | 2010024346 | A1 | 3/2010 |

OTHER PUBLICATIONS

Patant Cooperaton Treaty—International Searching Authority, PCT Notification of Transmittal of the International Search Report and the Written Opinion of the International Searching Authority, or the Declaration regarding Application No. PCT/US2019/047213 dated Nov. 1, 2019, 30 pages.

*Primary Examiner* — Jennifer C Chiang
(74) *Attorney, Agent, or Firm* — Cislo & Thomas, LLP

(57) ABSTRACT

A four color multi-pencil capable of one-handed operation is presented. Each color is contained in a cartridge assembly and each cartridge assembly may be individually selected for use and the material within the cartridge advanced for dispensing by means of a single pressing motion. The multi-pencil is designed to be a "snap together" assembly. No fasteners or adhesives are required. The multi-pencil contains a main body and a barrel. Housed within the barrel are a plurality of cartridge assemblies. Housed within the main body are a plurality of slide members for actuating the cartridges. Each cartridge assembly contains a mechanism for advancing drawing material or material to be dispensed.

23 Claims, 18 Drawing Sheets

(56) References Cited

U.S. PATENT DOCUMENTS

| | | | |
|---|---|---|---|
| 2015/0313343 | A1 | 11/2015 | Weibl |
| 2015/0343832 | A1 | 12/2015 | Tani |
| 2017/0151824 | A1 | 6/2017 | Tani |
| 2017/0151826 | A1 | 6/2017 | Tani |

ONE-HAND OPERATED MULTI-PENCIL

CROSS-REFERENCES TO RELATED APPLICATION

This application is a continuation-in-part of, and claims the benefit of, U.S. patent application Ser. No. 16/430,010, filed on Jun. 3, 2019 and entitled One-Hand Operated Multi-Pencil," and the benefit of U.S. Provisional Application Ser. No. 62/792,629, filed Jan. 15, 2019 and entitled "One-Hand Operated Multi-Pencil," both of which are incorporated herein by this reference.

BACKGROUND OF THE INVENTION

Field of the Invention

This invention relates to multi-pencils and, in particular, to a one-hand operated multi-pencil for dispensing extrudable, cartridge contained drawing materials.

Background Art

Multi-pencils are popular among women for the application of eyeliner and eyeshadow. It is frequently desirable to apply eyeliner and eyeshadow in different and various colors. Individual eyeliner and eyeshadow pencils have been employed to this end in the past, but such practice has been awkward and inconvenient since it requires a multiplicity of duplicate implements of different colors. Several types of pencils provided with different color dispensing elements have been produced or proposed. These pencils have dispensing elements that can be selectively advanced and retracted from a dispensing position. While such prior art devices obviate the need for a plurality of different color pencils, they possess certain drawbacks. In particular, the cartridge advancing and dispensing mechanism typically requires a combination of a sliding and rotating motion which requires two hands to operate. Users therefore, find such devices awkward and generally difficult to operate.

There is a need in the art for an improved multi-pencil where the cartridge advancement and material extrusion may be accomplished with one hand, thereby greatly improving the usability of such devices.

SUMMARY OF THE INVENTION

The present invention meets a long-felt need in the art by providing a multi-pencil capable of one hand operation. The exemplary embodiment of the present invention multi-pencil is a four-color pencil. The principles disclosed can be used to create multi-pencils of both fewer and greater than four colors. Each color is contained in a cartridge and each cartridge may be individually selected for use and the material within the cartridge advanced for dispensing by means of a single pressing motion that may be accomplished with one hand. The multi-pencil is designed to be a "snap together" assembly. No fasteners or adhesives are required to assemble the product.

The multi-pencil contains a main body and a barrel. Housed within the barrel are a plurality of cartridge assemblies. Housed within the main body are a plurality of slide members or cartridge selectors. Each cartridge assembly contains a mechanism for advancing drawing material or material to be dispensed, which is operated by simply depressing a cartridge (i.e. color) selector. This feature allows for one-hand operation of the multi-pencil and thereby improves upon prior art designs which require that both a color selector be depressed and the main body rotated relative to the barrel to advance the drawing material.

The above and other advantages of the multi-pencil of the present invention will be described in more detail below.

BRIEF DESCRIPTION OF DRAWINGS

FIG. 36 is a rear view of the pushing piston of the multi-pencil of the present invention.

DETAILED DESCRIPTION OF THE PREFERRED EMBODIMENTS

Figure 1:
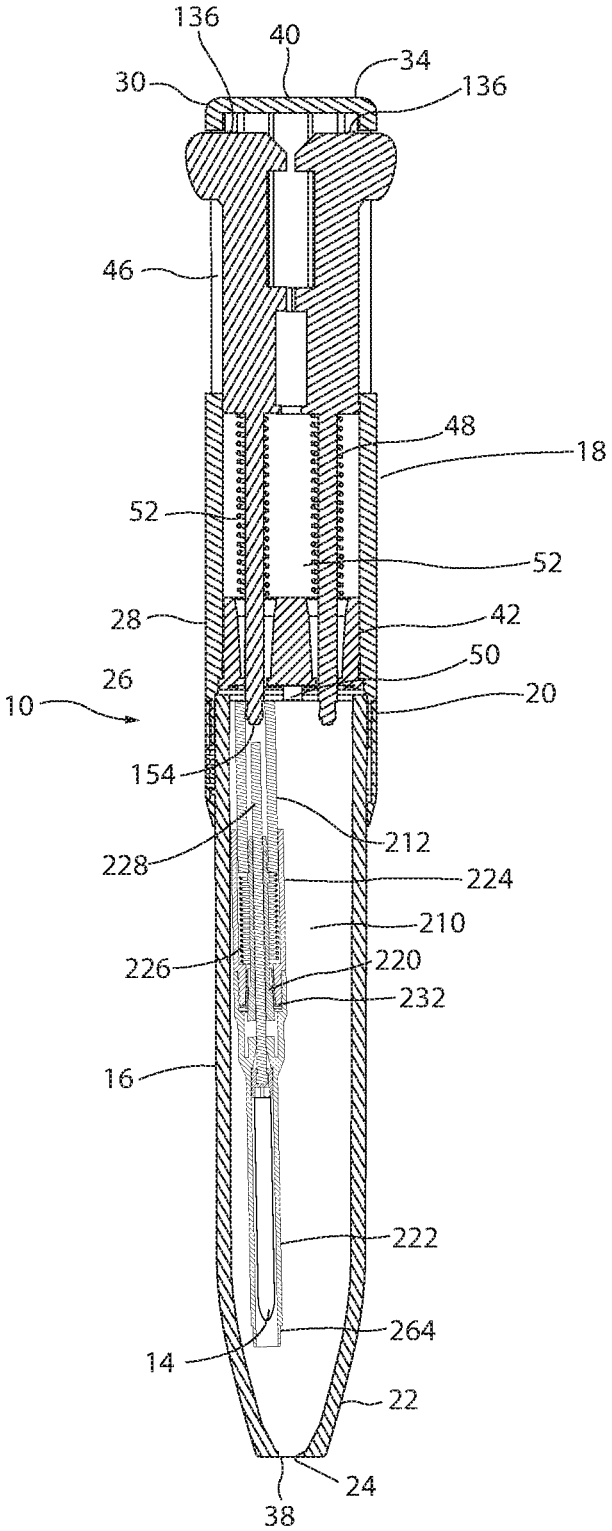
FIG. 1 is a side, sectional view illustrating a multi-pencil in accordance with the present invention, in an at-rest position, with only one selector and cartridge assembly shown for clarity.

The present invention will now be described more fully hereinafter with reference to the accompanying drawings, in which preferred embodiments of the invention are shown. The invention however, may be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

Description of the Component Parts

The exemplary embodiment of the present invention multi-pencil 10 is a four-color pencil. The principles disclosed can be used to create multi-pencils of both fewer and greater than four colors. Each color is contained in a cartridge assembly 210 and each cartridge assembly may be individually selected for use and the drawing material 14 within the cartridge assembly advanced for dispensing by means of a single pressing motion that may be accomplished with one hand.

With reference to FIG. 1, in the following description, an "axial line" means a center line which extends from a center 38 of an exit aperture 24 of a barrel 16 to a center 40 of an upper end 34 of a main body 18. An "axial direction" means a direction along the axial line in a forward or upward direction and in an aft or downward direction, where "downward" or "aft" corresponds to a direction from the center 40 of the upper end 34 of the main body 18 towards the center 38 of the exit aperture 24 of the barrel 16 and "upward" or "forward" corresponds to a direction from the center 38 of the exit aperture 24 towards the center 40 of the upper end 34 of the main body 18.

With reference to FIGS. 1-18, the major components of the present invention multi-pencil 10 include the barrel 16, the main body 18, and a mid-body 20 which interconnects the barrel 16 and main body 18, and cartridge assemblies 210. The barrel 16 has a generally cylindrical upper (forward) portion and has a tapered lower (aft) portion or leading portion 22 terminating in an exit aperture 24. The barrel has an open upper (forward) end 26. The main body 18 is generally cylindrical and has a lower (aft) cylindrical portion 28 with an open lower (aft) end 32 (see FIG. 10) and a slotted upper (forward) portion 30 with a closed upper (forward) end 34.

The barrel 16 and the main body 18 are interconnected by means of a generally cylindrical mid-body 20. Disposed within the mid-body 20 is a main body biasing spring 36, which biases the main body 18 away from the barrel 16 in an axial direction.

Disposed within the lower (aft) cylindrical portion 28 of the main body 18 is a guide plug 42. Also disposed within the main body 18 are four slide members or cartridge selectors 46, wherein each slide member 46 is biased upwardly by a slide member return spring 52, supported by the guide plug 42. Each slide member 46 includes an operating rod 48 which is guided by and slides through a guide hole 50 in the guide plug 42. The guide plug 42 serves to uniformly space the slide members 46 about the inside periphery of the main body 18.

Each operating rod 48 has a ball end 154 which includes a plurality of flexible fingers 202. The ball end 154 and flexible fingers 202 of the operating rod 48 engage an aperture or socket 216 at an upper end 214 of an engaging sleeve 212 of the cartridge assembly 210. This form of engagement allows angulation of the cartridge assembly 210 at the connection with the operating rod 48 of the slide member 46. (See FIGS. 2-4.) Angulation of the cartridge assembly 210 allows an aft end 218 of the cartridge assembly 210 to deflect radially inwardly as it slides downwardly along the leading portion 22 of the barrel 16 and to extend from the aperture 24 of the barrel 16, when the slide member 46 associated with a particular cartridge assembly is actuated to deploy the cartridge assembly for use.

With reference to FIGS. 6A and 19-36, the cartridge assembly 210 comprises the engaging sleeve 212, a movable sleeve 220, a spring retainer 224, a material holder 222, a biasing spring 226, a material pushing rod 228, a material pushing piston 230, a tapered, hollow cylindrical sleeve 232, and drawing material or material to be dispensed 14.

With reference to FIGS. 6A and 19-21, the movable sleeve 220 is a hollow, cylindrical body having an inside diameter 240 and an aft end 242 and a forward end 244. The inside diameter 240 is sized to be a slip fit with an outside diameter 310 of the material pushing rod 228. The movable sleeve 220 includes a mid-body portion 234, a split tapered cylindrical portion 236, and an engagement portion 238. The split tapered cylindrical portion 236 includes slots 246 which split the tapered cylindrical portion into a first half 248 and a second half 250. The split tapered cylindrical portion 236 functions to releasably engage the material pushing rod 228. The engagement portion 238 includes engagement features 280 which engage via a snap fit with engagement features 282 of the engaging sleeve 212.

With reference to FIGS. 6A and 31-33, the material holder 222 is a hollow cylindrical body having an aft end 252, a forward end 254, and a first inside diameter 256 which is sized to be a slip fit with an outside diameter 268 of the material pushing piston 228. The material holder 222 includes an aft portion 262, a mid-body portion 266, an engagement portion 270, and a pushing rod support portion 272. The aft portion 262 includes a cylindrical stop surface 264. The pushing rod support portion 272 includes an inside diameter 258 sized to be a slip fit with an outside diameter 274 of the material pushing rod 228. The pushing rod support portion 272 also includes a cylindrical seating surface 260 for the material pushing piston 230. The engagement portion 270 of the material holder includes threads 276 which engage threads 278 formed on the spring retainer 224 and includes a cylindrical stop surface 328.

The cylindrical stop surface 264 of the material holder 222 engages the leading surface 22 of the barrel 16 at or near the coaxial aperture 24, during a downward (aft) stroke of the slide member 46 and cartridge assembly 210 and thereby limits the maximum extension of the material holder 222 from the leading edge 22 of the barrel 16. The aft end 262 of the material holder 222 has an opening 257, wherein the drawing material 14 may be extruded from the opening 257 upon actuation of the multi-pencil 10.

With reference to FIGS. 6A and 22-24, the spring retainer 224 is a hollow, cylindrical element having an aft portion 284, an aft end 324, a forward portion 286, and a forward end 326. The aft portion 284 features a tapered, cylindrical interior surface 290 that engages via a press fit with a tapered, cylindrical exterior surface 292 of the tapered, hollow cylindrical sleeve 232. The aft portion 284 also includes external threads 278 which engage with the threads 276 of the material holder 222. The forward portion 286 has an inside diameter 296 which is configured to be in a slip fit relationship with an external diameter 298 of the engaging sleeve 212. The spring retainer 224 also includes a seating surface 288. The biasing spring 266 abuts the seating surface 288.

Figure 6A:
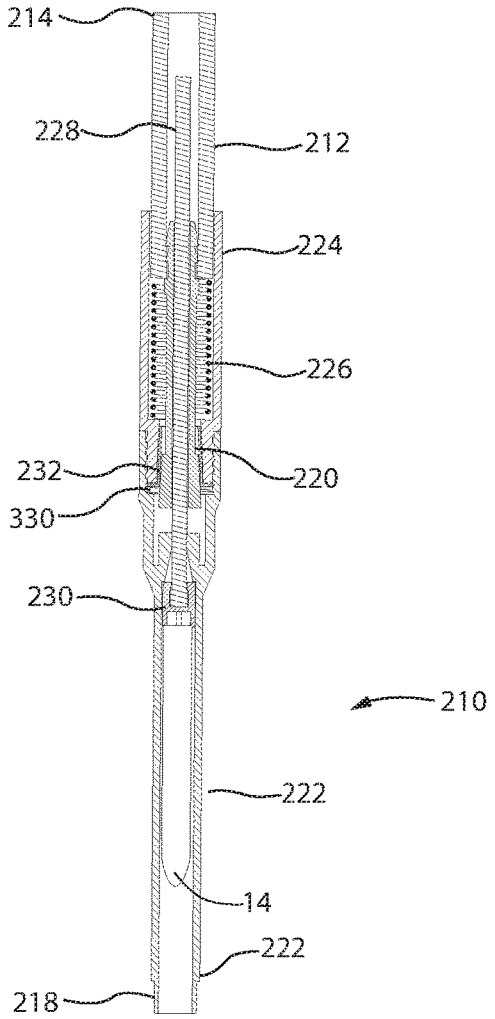
FIG. 6A is a side, sectional view illustrating a cartridge assembly of the multi-pencil of the present invention, showing a tapered, cylindrical sleeve at a forward end of an engaging gap.
Figure 29:
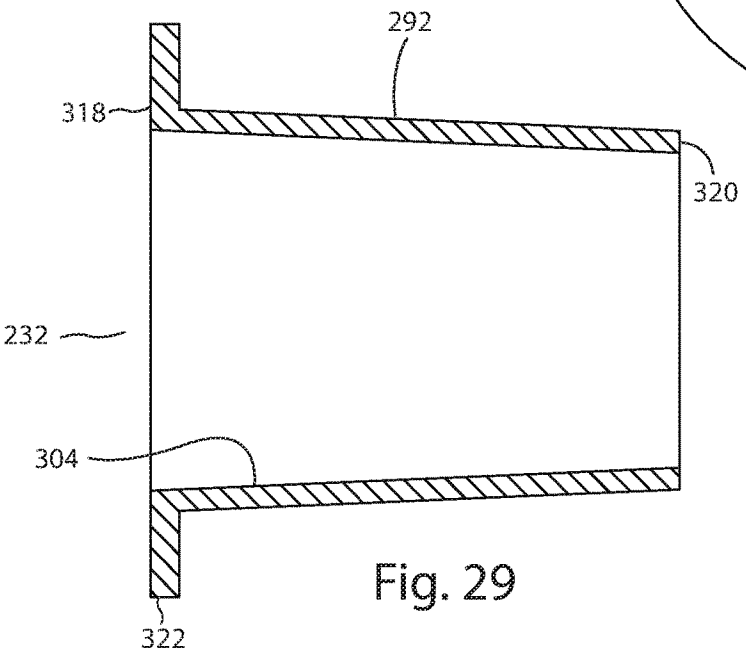
FIG. 29 is a sectional view of the tapered cylindrical sleeve of the multi-pencil of the present invention taken along the line 29-29 of FIG. 28.
Figure 27:
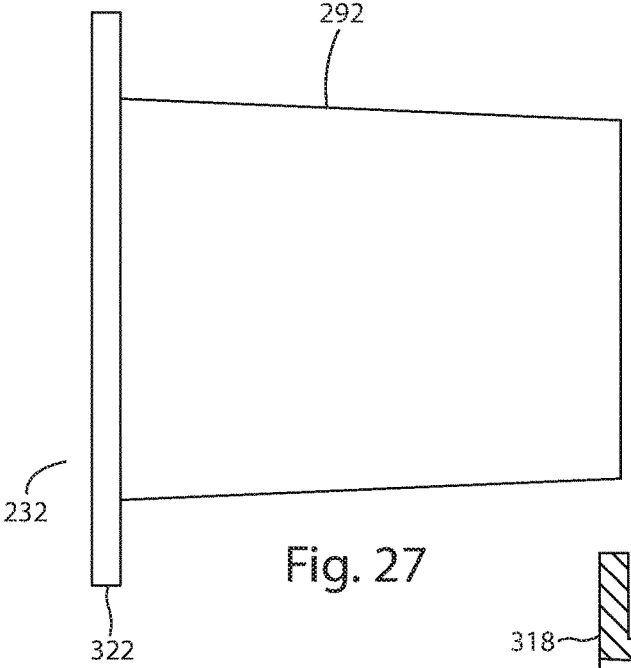
FIG. 27 is side view of the tapered, cylindrical sleeve of the present invention.
Figure 30:
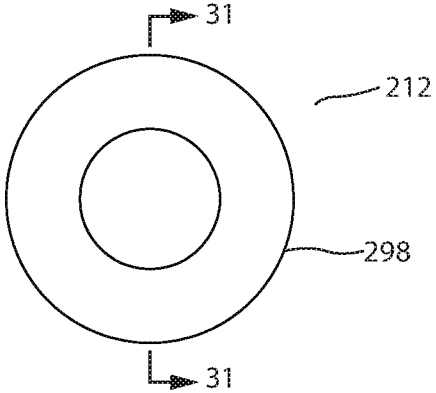
FIG. 30 is an end view of the engaging sleeve of the present invention.
Figure 31:
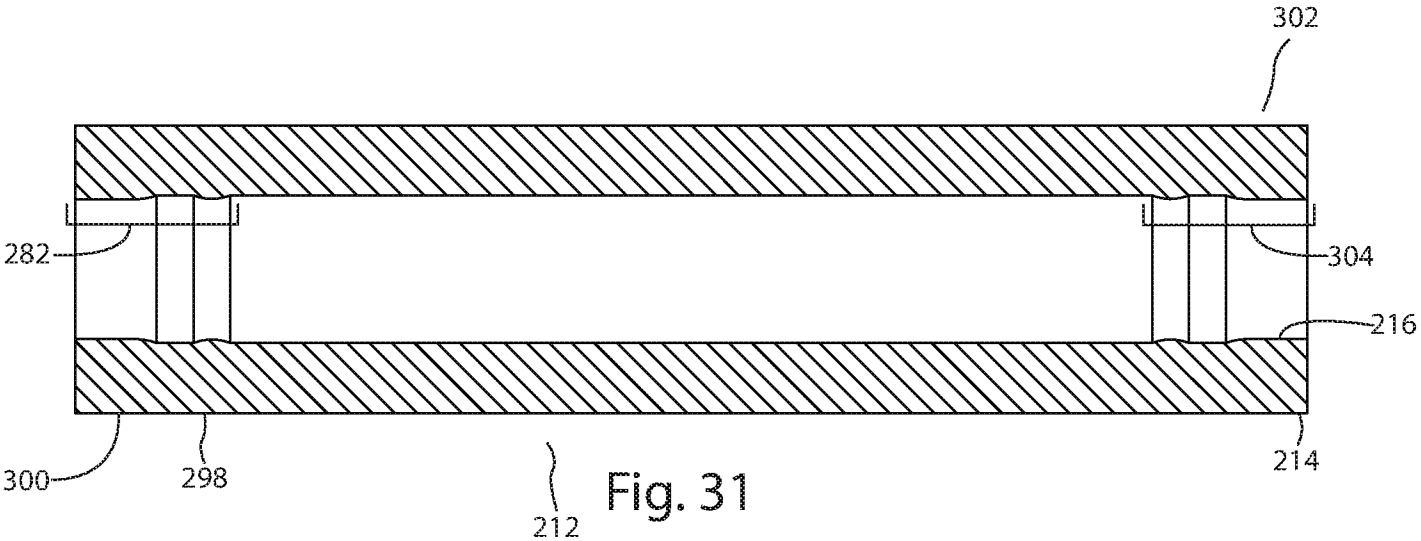
FIG. 31 is a side sectional view of the engaging sleeve of the present invention taken along the line 31-31 of FIG. 30.
Figure 32:
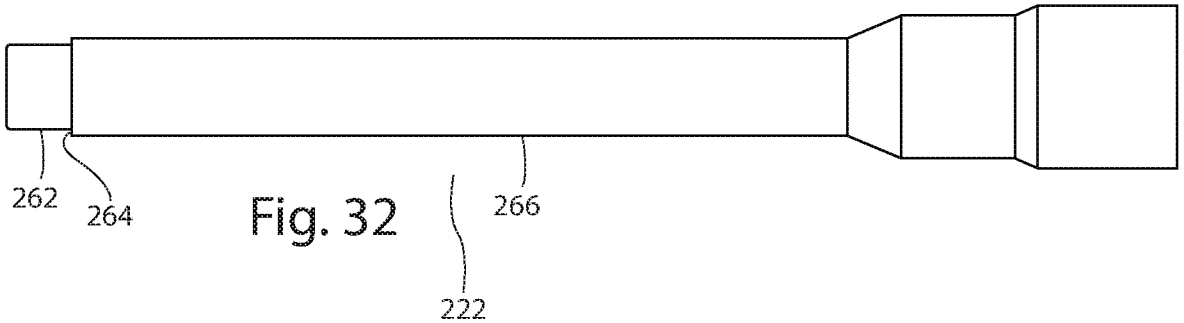
FIG. 32 is side view of the material holder of the present invention.
Figure 34:
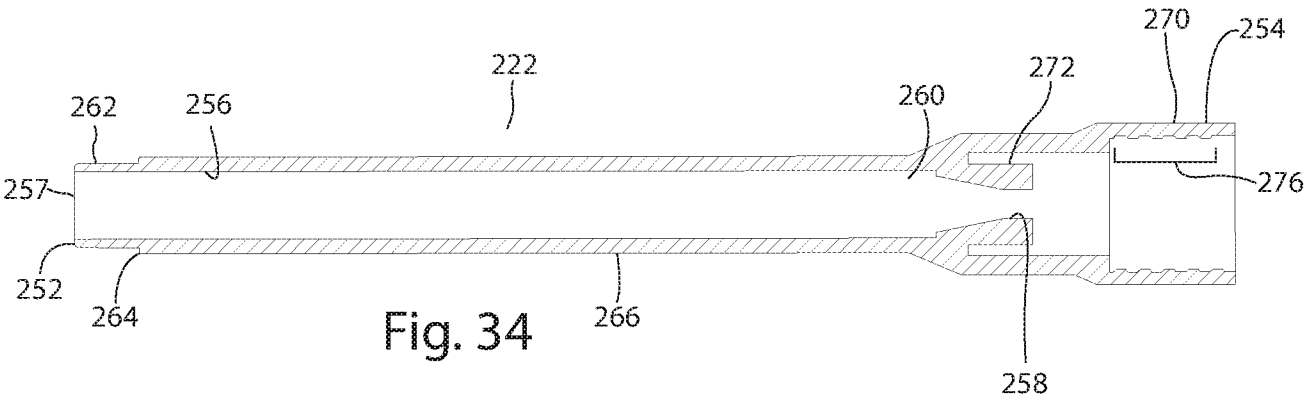
FIG. 34 is a side sectional view of the material holder of the multi-pencil of the present invention, taken along the line 34-34 of FIG. 33.
Figure 33:
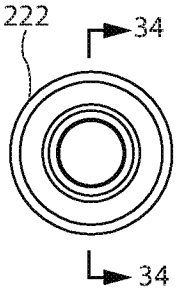
FIG. 33 is a front view of the material holder of the multi-pencil of the present invention.
Figure 35:
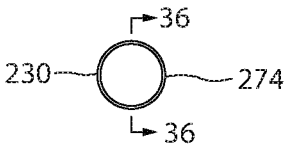
FIG. 35 is a front view of the pushing piston of the present invention.
Figure 36:
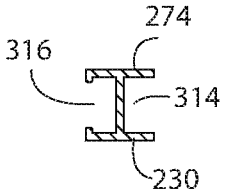
FIG. 36 is a side sectional view of the pushing piston of the present invention, taken along the line 36-36 of FIG. 35.
Figure 37:
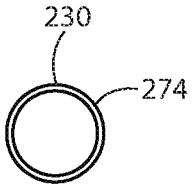
FIG. 37 is a front view of the pushing piston of the multi-pencil of the present invention.

With reference to FIGS. 6A and 29-30, the engaging sleeve 212 is a hollow, cylindrical element having an aft end 300 and a forward end 302. The aft end 300 features engagement features 282 that engage via a press fit with the engagement features 280 of the movable sleeve 220. The forward end 302 includes a socket 216 with engagement features that engage with the flexible fingers 202 of the operating rod 48.

With reference to FIGS. 6A and 26-28, the tapered cylindrical sleeve 232 has an aft end 318, a forward end 320, a tapered, cylindrical exterior surface 292, a lip 322, and a tapered, cylindrical interior surface 304. The tapered, cylindrical exterior surface 292 is configured to be a press fit with the tapered, cylindrical interior surface 290 of the spring retainer 224. The tapered, cylindrical interior surface 304 is configured to be releasably engagable with the exterior of the split, tapered, cylindrical portion 236 of the movable sleeve 220. To reduce the force required to release the split, tapered, cylindrical portion 236 of the movable sleeve 220 from the tapered, interior cylindrical surface 304 of the tapered, cylindrical sleeve 232 it is desirable to make the two components from dissimilar materials. In the exemplary embodiment, the movable sleeve 220, and thus the split, tapered cylindrical portion 236, is made of a plastic or polymer material. The tapered, cylindrical sleeve 232 is made from a metallic material.

Figure 24:
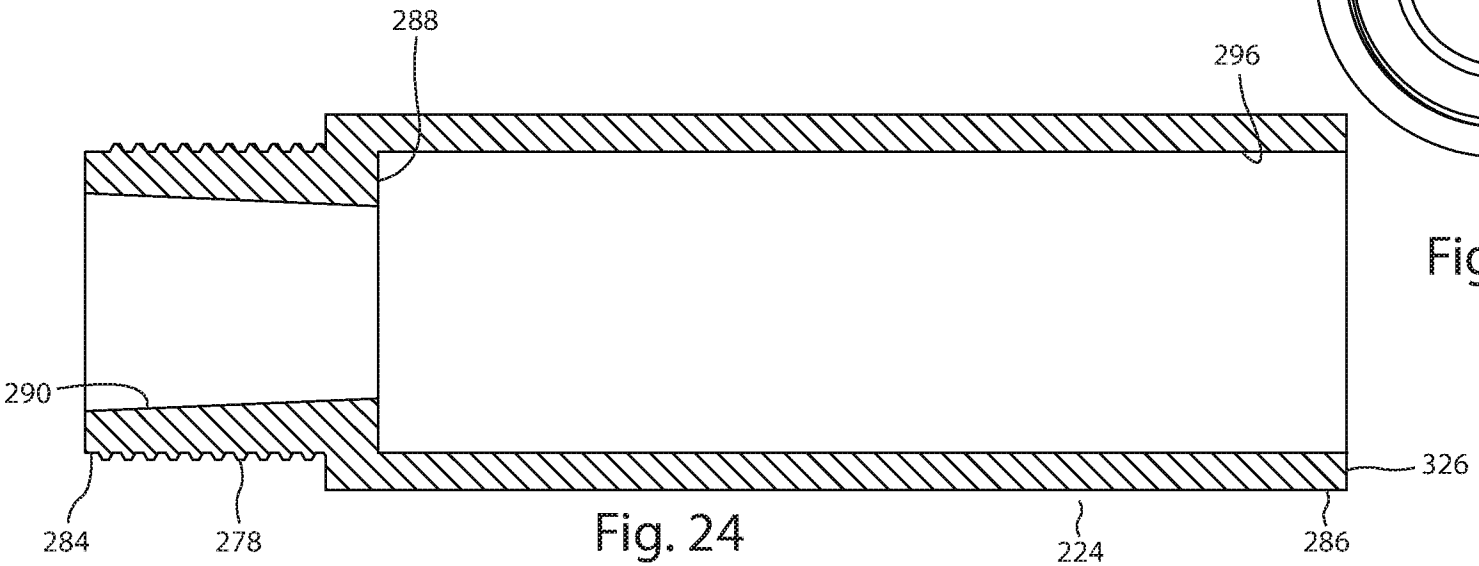
FIG. 24 is a cross-sectional view of the spring retainer taken along the line 24-24 of FIG. 23.
Figure 25:
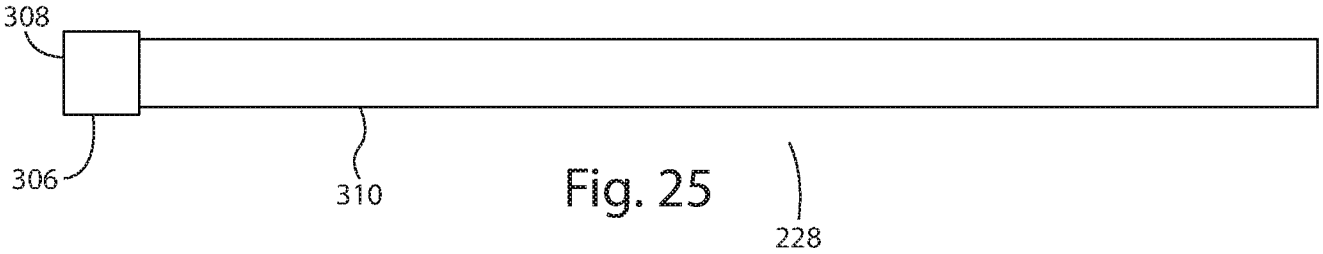
FIG. 25 is side view of the pushing rod of the multi-pencil of the present invention.
Figure 26:
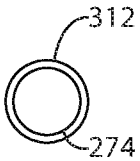
FIG. 26 is a right end view of the pushing rod of the multi-pencil of the present invention.
Figure 28:
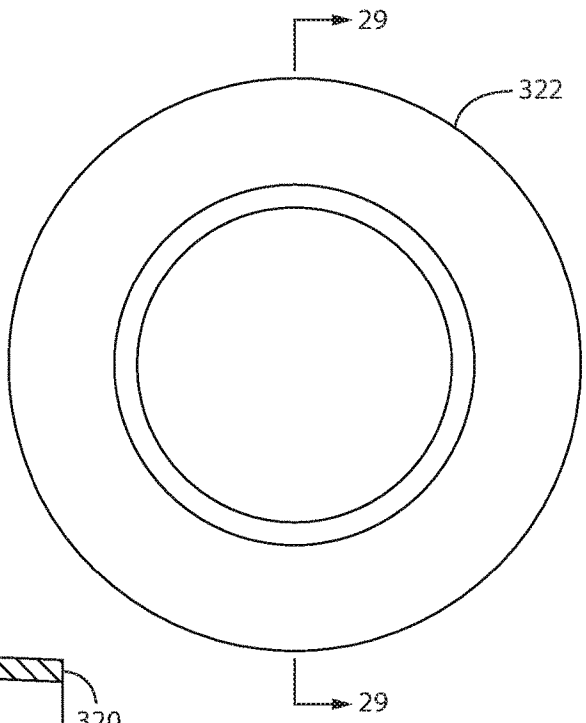
FIG. 28 is a front view of the tapered cylindrical sleeve of the multi-pencil of the present invention.

With reference to FIGS. 6A and 24-25, the pushing rod 228 is a cylindrical rod having a main body portion 310 having a forward end 307, an outside diameter 274 and an aft portion 306 having an outside diameter 312 and an end pad 308. In the exemplary embodiment, pushing rod 228 is made from a metallic material.

With reference to FIGS. 6A and 34-36, the pushing piston 230 is a cylindrical component having an aft cup portion 314 and a forward cup portion 316. The aft cup portion 314 serves to engage an end of the drawing material 14. The forward cup portion 416 engages the aft portion 306 of the pushing rod 228.

Assembly of the Cartridge Assembly

To assemble the cartridge assembly 210, in a first step, the forward cup portion 316 of the pushing piston 230 is snapped onto the aft portion 306 of the material pushing rod 228. In a second step, the forward end 307 of the material pushing rod 228 is inserted through the pushing rod support portion 272 of the material holder 222.

In a third step, the forward end 320 of the tapered, cylindrical sleeve 232 is pressed into the tapered, cylindrical interior surface 290 of the aft portion 284 of the spring retainer 224 until the lip 322 of the tapered, cylindrical sleeve 232 abuts the aft end 324 of the aft portion 284 of the spring retainer 224. In a fourth step, the forward end 244 of movable sleeve 220 is inserted into the aft end 324 of the spring retainer 224 until the split, tapered cylindrical portion 236 of the movable sleeve 220 rests within the tapered, cylindrical interior surface 290 of the spring retainer 224.

In a fifth step, the biasing spring 226 is slid over the forward end 244 of the movable sleeve 220 and inside the inside diameter or bore 296 of the spring retainer 224 until the biasing spring 226 abuts the seating surface 288 of the spring retainer. In a sixth step, the aft end 300 of the engaging sleeve 212 is inserted into the forward end 326 of the spring retainer 224 and about the forward end 244 of the movable sleeve 220, until the engagement features 282 of the engaging sleeve 212 engage (snap onto) the engagement features 280 of the movable sleeve 220. In this position, the engaging sleeve 212 will abut and preload the biasing spring 226.

In a seventh step, the forward end 307 of the material pushing rod 228 is inserted into aft end 242 of the movable sleeve 220. In an eighth step, the aft end 284 of the spring retainer 224 is attached (i.e. screwed into) the forward end 254 of the material holder 222 via threads 278 formed on the spring retainer 224 and threads 276 formed on the material holder 222. In a ninth and final step, the drawing material 14 is inserted into the aft end 252 of the material holder 222.

Operation of the Cartridge Assembly

The drawing material 14 is typically a semi-rigid or rigid material that is consumed as it is applied. Therefore, the drawing material 14 must be advanced within the material holder 222 such that a sufficient quantity of drawing material 14 extends from the open aft end 252 of the material holder 222, when the cartridge assembly 210 containing the material holder 222 has been selected for use, at which point the aft end 252 of the material holder 222 protrudes from the exit aperture 24 of the barrel 16.

With reference to FIGS. 1-4 and 6A, the operation of the cartridge assembly 210 to cause the drawing material 14 to be extruded from the cartridge assembly 210 is as follows.

With reference to FIG. 1, the cartridge assembly 210 is shown at rest within the barrel 16.

Figure 2:
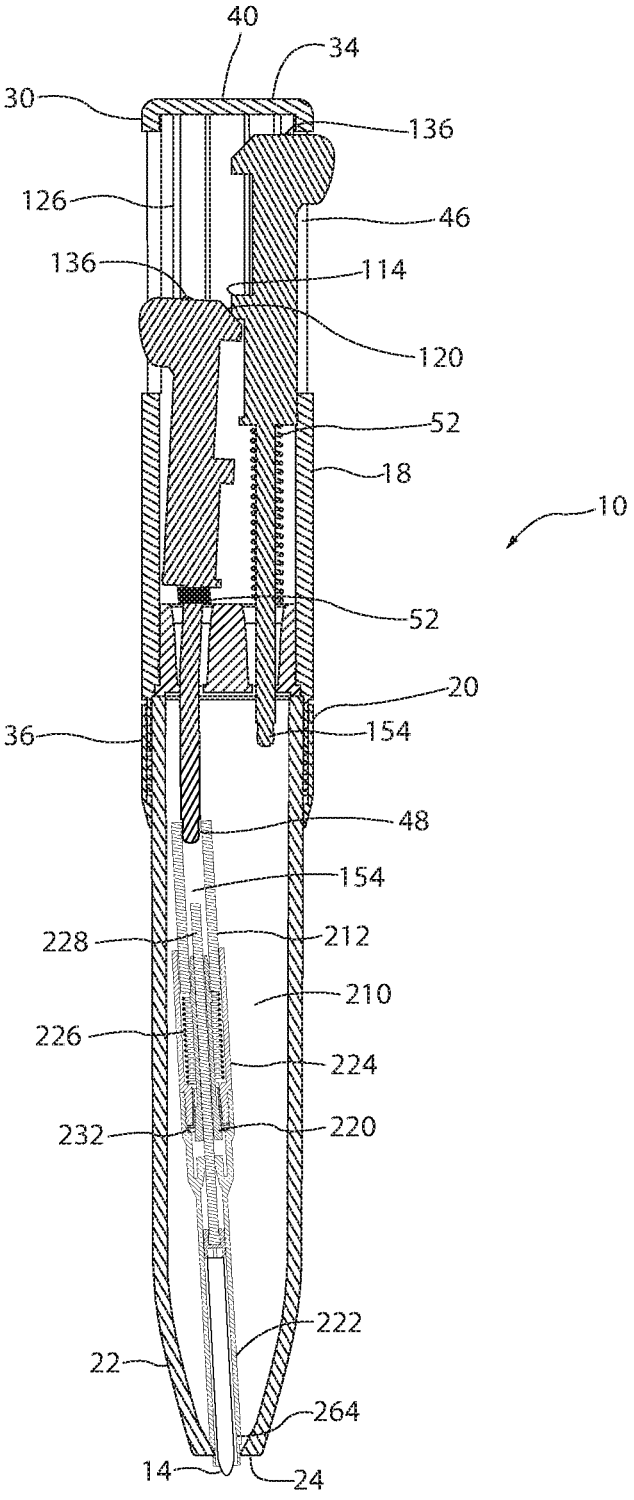
FIG. 2 is another side, sectional view of the multi-pencil of the present invention, shown with a cartridge selector in a depressed position, with only one selector and cartridge assembly shown for clarity.
Figure 3:
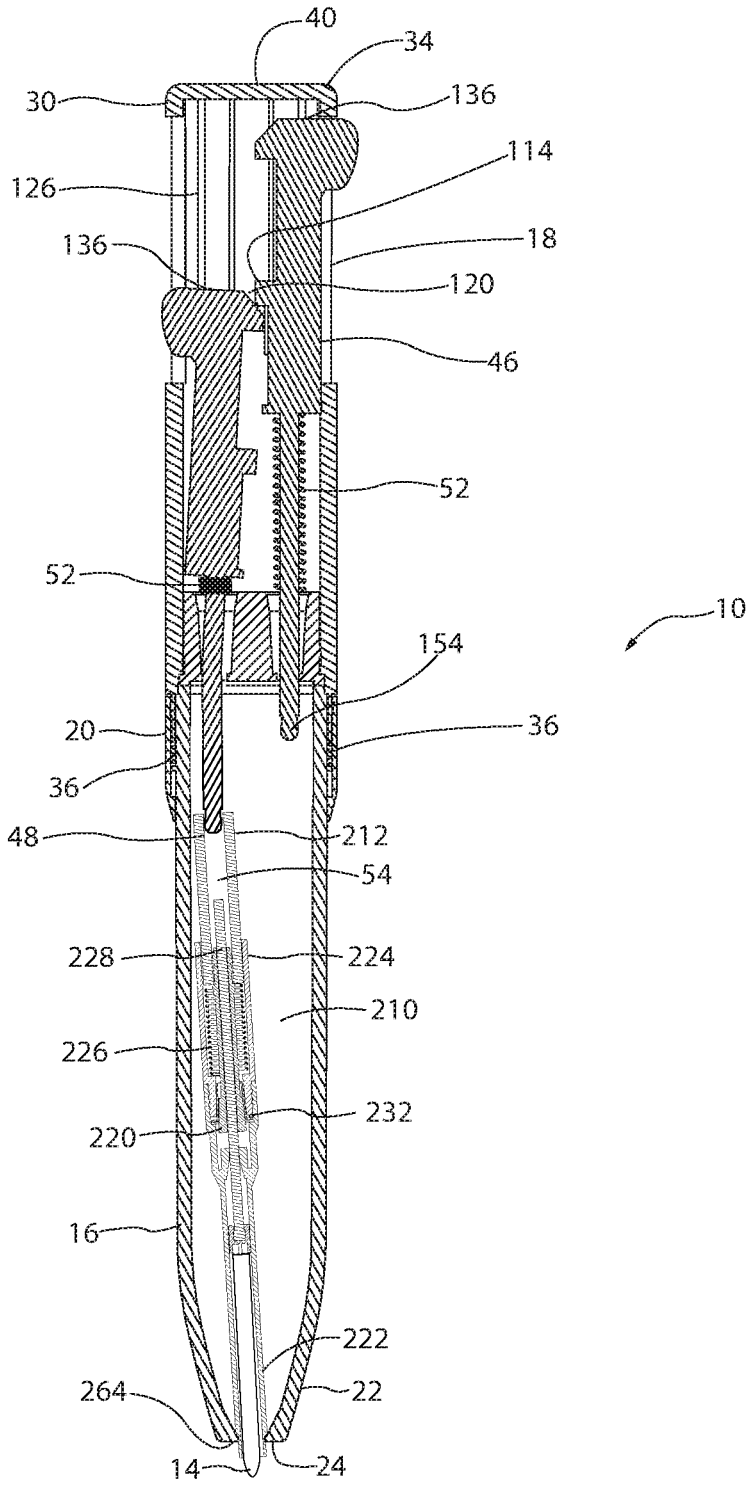
FIG. 3 is another side, sectional view of the multi-pencil of the present invention, shown with a cartridge selector depressed and a main body of the multi-pencil depressed relative to a barrel of the multi-pencil, with only one selector and cartridge assembly shown for clarity.
Figure 4:
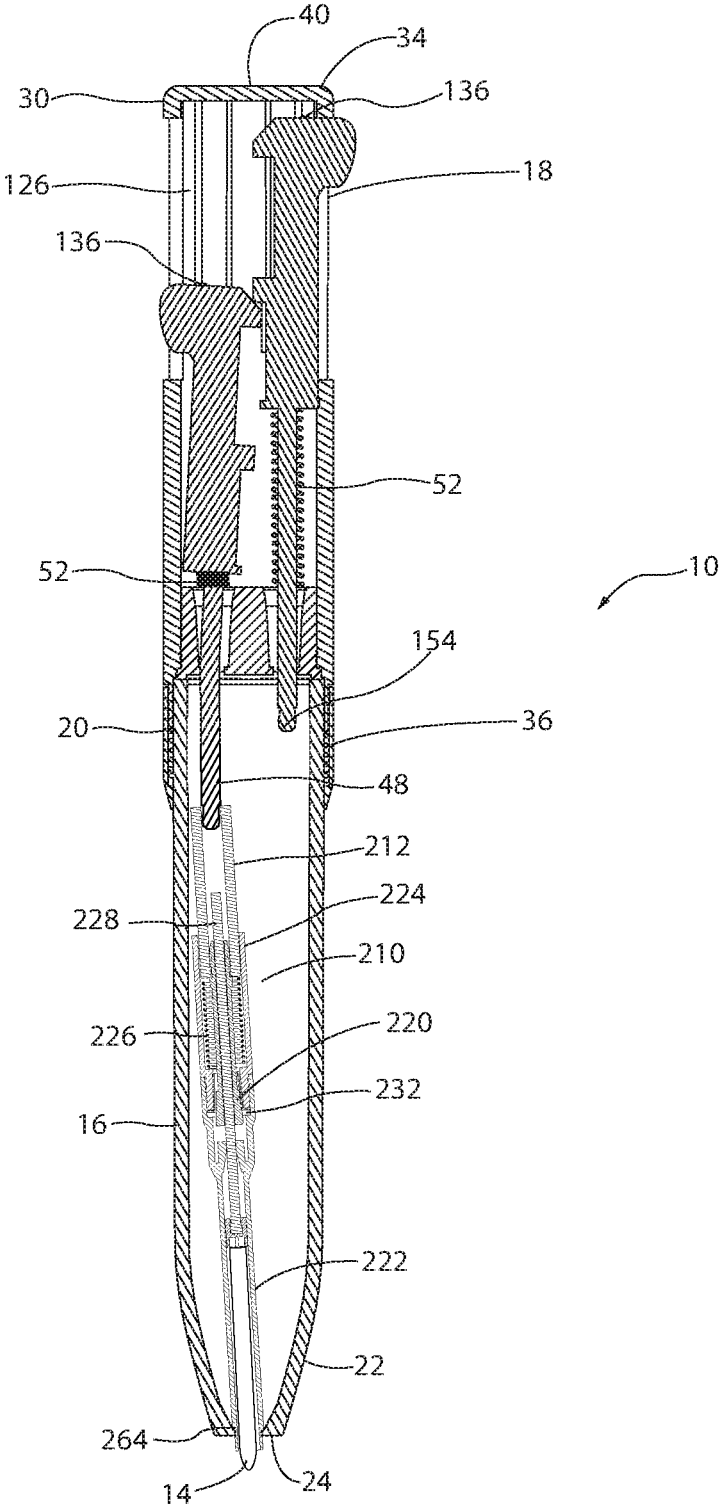
FIG. 4 is another side, sectional view of the multi-pencil of the present invention, shown with a cartridge selector depressed and with the main body of in an at-rest position relative to the barrel, with only one selector and cartridge assembly shown for clarity.

With reference to FIGS. 2 and 6A, a user depresses the slide member 46 which causes the slide member 46 to move axially downwardly or aft until catches 136 of the slide member 46 engage end points 152 of lower ledges 126 of the main body 18 (see FIGS. 2-4). The catches 136 hold the slide member 46 in place until released by a user. With the slide member 46 depressed and latched, the operating rod 48 of the slide member 46, which is engaged with an open forward end 302 of the engaging sleeve 212, causes the engaging sleeve 212 and thus the cartridge assembly 210 to move axially downwardly or aft within the barrel 16. Axial downward movement of the cartridge assembly 212 continues until the cylindrical stop surface 264 of the material holder 222 engages the exit aperture 24 of the barrel 16, at which point further downward movement of the cartridge assembly 210 is prevented. At this point the open aft end 252 of the material holder 222 extends from the exit aperture 24 of the barrel 16.

With reference to FIGS. 3 and 6A, a user holds the barrel 16 and presses axially downwardly on the main body 18. The amount of downward movement of the main body 18 relative to the barrel 16 is controlled by the compression height of the main body biasing spring 36. The application of force to cause axially downward movement on the main body 18 also causes the slide member 46 to move axially downwardly due to its being locked in place to the main body 18.

With continued reference to FIGS. 3 and 6A, axial downward movement of the locked-in-place slide member 46 causes the engaging sleeve 212, via the operating rod 48, to move downwardly inside the spring retainer 224. Because the engaging sleeve 212 is fixed to the movable sleeve 220, the movable sleeve 220 also moves downwardly or aft, as well. The movable sleeve 220 holds the material pushing rod 228 in place by friction. Therefore, the material pushing rod 228 also moves downwardly and through the pushing rod support portion 272 of the material holder 222. The pushing piston 230 being connected to the material pushing rod 228 also moves downwardly through the material holder 222, thereby advancing the drawing material 14 within the material holder 222 and out the open aft end 252 of the material holder 222.

The movable sleeve 220 holds the material pushing rod 228 in place by friction by means of the split, tapered cylindrical portion 236 of the material holder 222. That is, due to the tapered interface between the interior surface of the tapered, hollow, cylindrical sleeve 232 and the tapered, cylindrical, exterior surface of the first half 248 and the second half 250 of the split, tapered, cylindrical portion 236, clamping pressure or an applied force is exerted on the first half 248 and second half 250 by the tapered, hollow, cylindrical sleeve 232, causing the first half 248 and second half 250 to deflect inwardly upon, and engage, the material pushing rod 228.

Figure 6B:
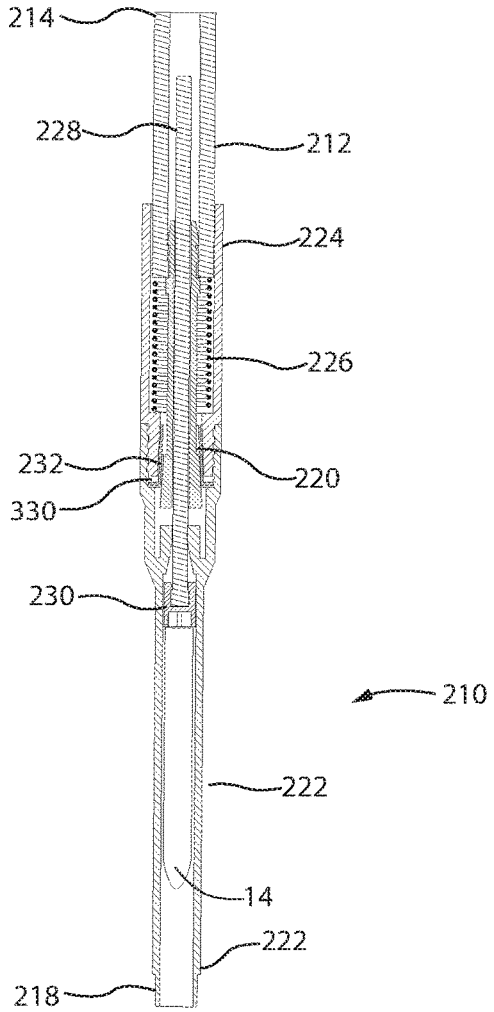
FIG. 6B is another side, sectional view illustrating a cartridge assembly of the multi-pencil of the present invention, showing the tapered, cylindrical sleeve an aft end of an engaging gap.

With reference to FIGS. 3 and 6B, as the movable sleeve 220 moves aft or downwardly within the spring retainer 224, the tapered, hollow, cylindrical sleeve 232 moves aft or downwardly as well, as it is engaged with and rides along with the movable sleeve 220. The tapered, hollow cylindrical sleeve 232 moves downwardly or aft until the lip 328 of the sleeve 232 abuts the cylindrical stop surface 328 of the material holder 222.

With reference to FIGS. 3 and 6B, upon abutting the cylindrical stop surface 328, downward or aft movement of the tapered, hollow cylindrical sleeve 232 is prevented and the first half 248 and second half 250 of the split, tapered, cylindrical portion 236 of the movable sleeve 220 separate from the tapered, hollow cylindrical sleeve 232. Upon separation of the first half 248 and the second half 250 from the tapered, hollow, cylindrical sleeve 232, the clamping pressure or applied force on the first half 248 and the second half 250 is relieved and consequently, the first half 248 and the second half 250 disengage from and release the material pushing rod 228.

With reference to FIGS. 4 and 6A, after a user has depressed the main body 18 relative to the barrel 16, when the user releases the main body 18, the main body biasing spring 36 drives the main body 18 upwardly or forward. At the same time, the biasing spring 226 of the cartridge assembly 210 drives the engaging sleeve 212 and the connected movable sleeve 220 upwardly or forward relative to the spring retainer 224 and connected material holder 222. During this upwards or forward movement, the movable sleeve 220 being disengaged from the material pushing rod 228 moves upwards or forward over the material pushing rod 228, while the material pushing rod 228 remains stationary.

With continued reference to FIGS. 4 and 6A, due to force exerted by the biasing spring 226, during the upwards or forward movement of the movable sleeve 220, the split, tapered cylindrical portion 236 of the movable sleeve 220 engages the tapered, hollow cylindrical sleeve 232 and draws it upwardly or forward until the lip 322 of the tapered, hollow cylindrical sleeve 232 abuts the aft end 284 of the spring retainer 224. At this point, the biasing spring 226 causes the tapered, hollow cylindrical sleeve 232 to again exert clamping pressure or an applied force on the first half 248 and second half 250 of the tapered, cylindrical portion 236 of the movable sleeve 220 to again cause the first half 248 and the second half 250 to deflect inwardly and engage the material pushing rod 228, i.e. to hold the material pushing rod in place via friction. At this point, the multi-pencil 10 and cartridge assembly 210 have returned to their non-actuated or at rest position as shown in FIGS. 1 and 6A.

In the above-described actuation cycle, the distance between the location of the lip 322 of the tapered, hollow cylindrical sleeve 232 when in the at rest position where the lip 322 abuts aft end 284 of the spring retainer 224 (see FIG. 6A) and the position of the lip 322 when the cartridge assembly has been actuated, i.e. when the lip 322 abuts the cylindrical stop surface 328 of the material holder 222 (see FIG. 6B), is defined as the engagement gap 330.

The actuation cycle describe above may be repeated as many times as desired by a user. Each actuation cycle will advance drawing material 14 from the cartridge assembly 210.

Description and Operation of the Slide Member Latch Features

Figure 5:
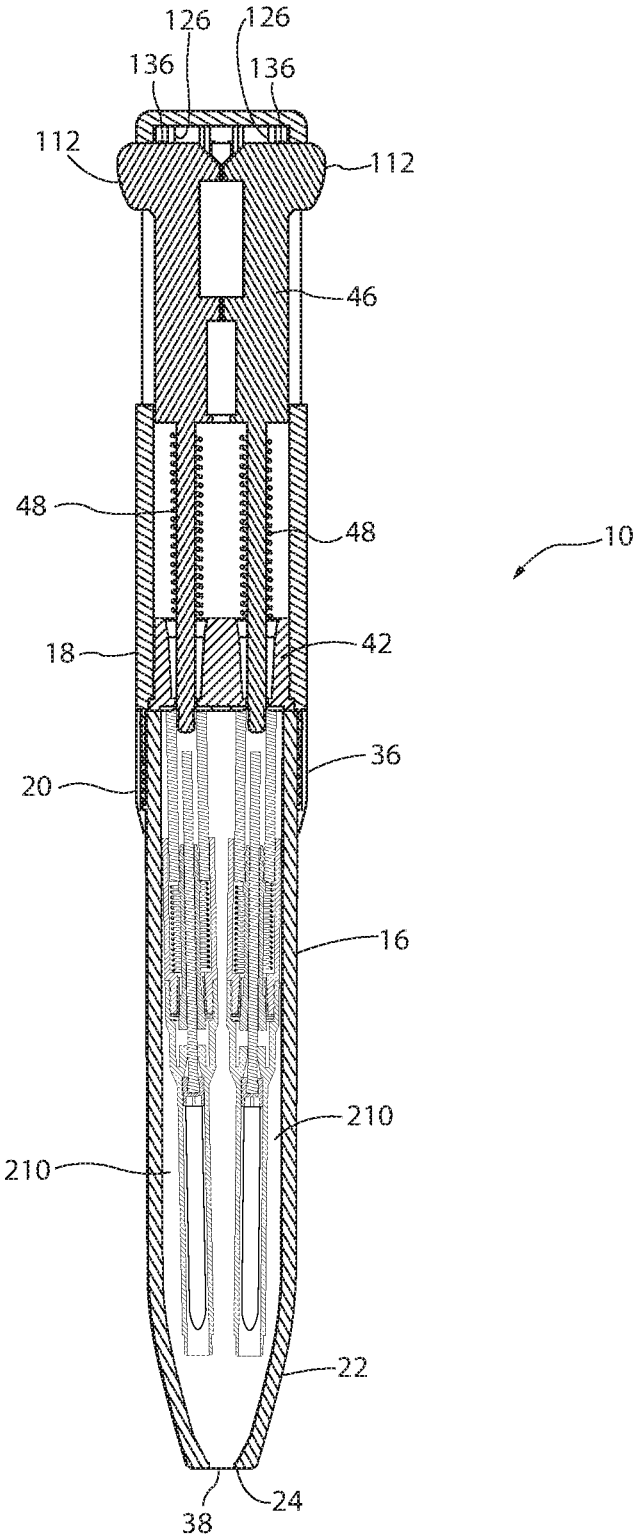
FIG. 5 is a side, sectional view illustrating the multi-pencil of the present invention, in an at-rest position.

With reference to FIG. 5, a cross-sectional view of the multi-pencil 10 of the present invention is shown with the slide members 46 and cartridge assemblies 210 retracted. Only two slide members 46 and cartridge assemblies 210 are shown for clarity.

Figure 7:
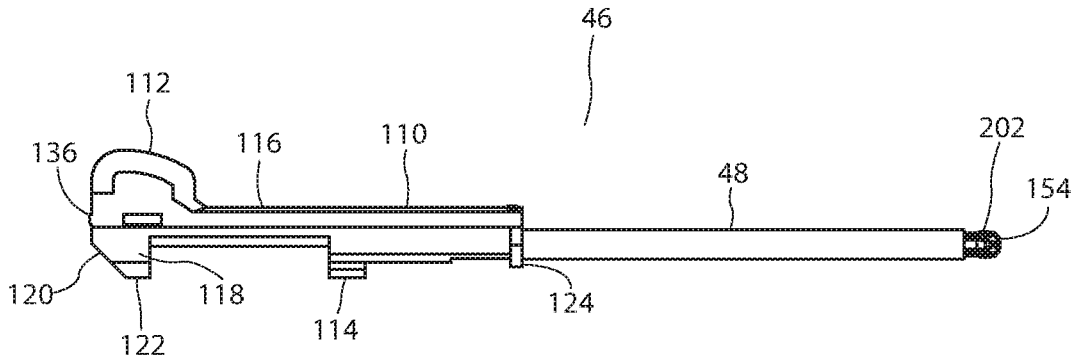
FIG. 7 is a side view of the cartridge selector or slide member of the multi-pencil of the present invention.
Figure 8:
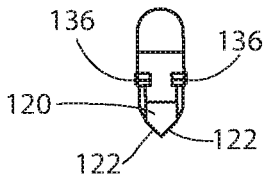
FIG. 8 is a left end view of the cartridge selector or slide member of the multi-pencil of the present invention.
Figure 9:
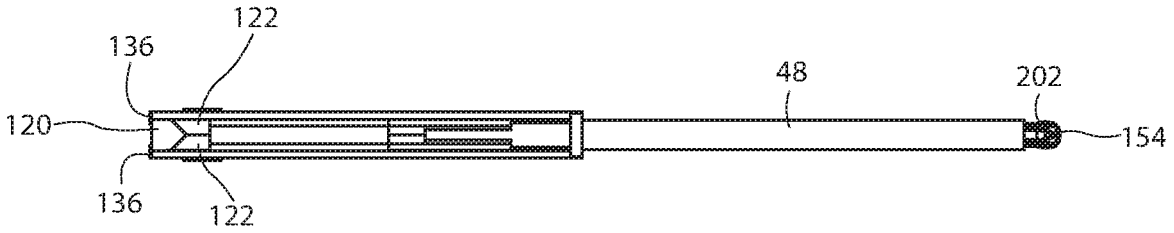
FIG. 9 is a bottom view of the cartridge selector or slide member of the multi-pencil of the present invention.

Referring now to FIGS. 7-9, the slide member 46 is shown in more detail. The slide member 46 includes an upper (forward) portion 110 and the operating rod 48. The upper (forward) portion 110 includes a finger tab 112, a striker 114, guides 116, catches 136, a spring abutment surface 124, and a disengagement member 118. The disengagement member 118 features a rear angled surface 120 and two mutually opposed side, angled surfaces 122.

Figure 10:
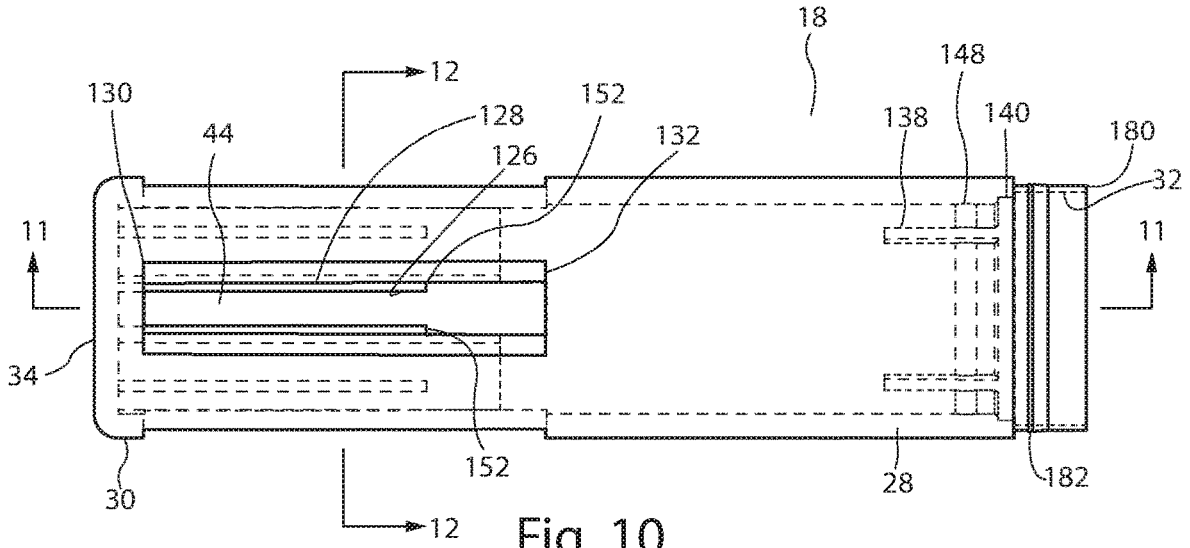
FIG. 10 is a side view of the main body of the multi-pencil of the present invention.
Figure 11:
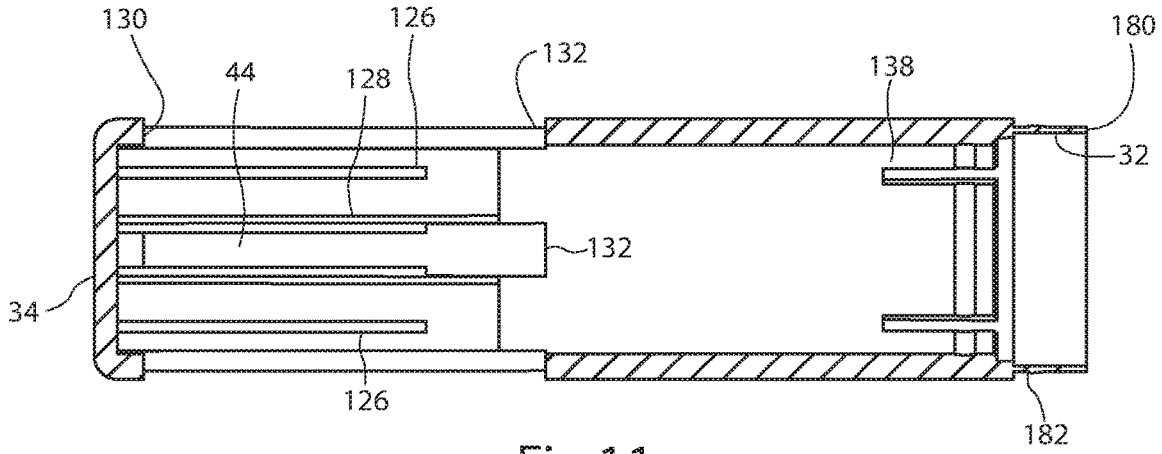
FIG. 11 is sectional view along the 11-11 of FIG. 10 of the main body of the multi-pencil of the present invention.
Figure 12:
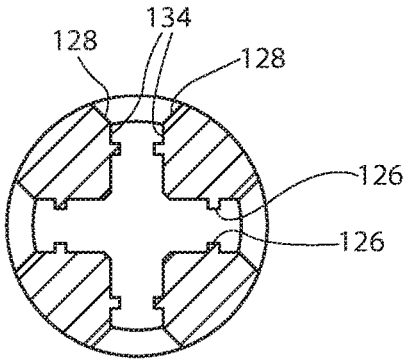
FIG. 12 is a left end view of the main body of the multi-pencil of the present invention.
Figure 13:
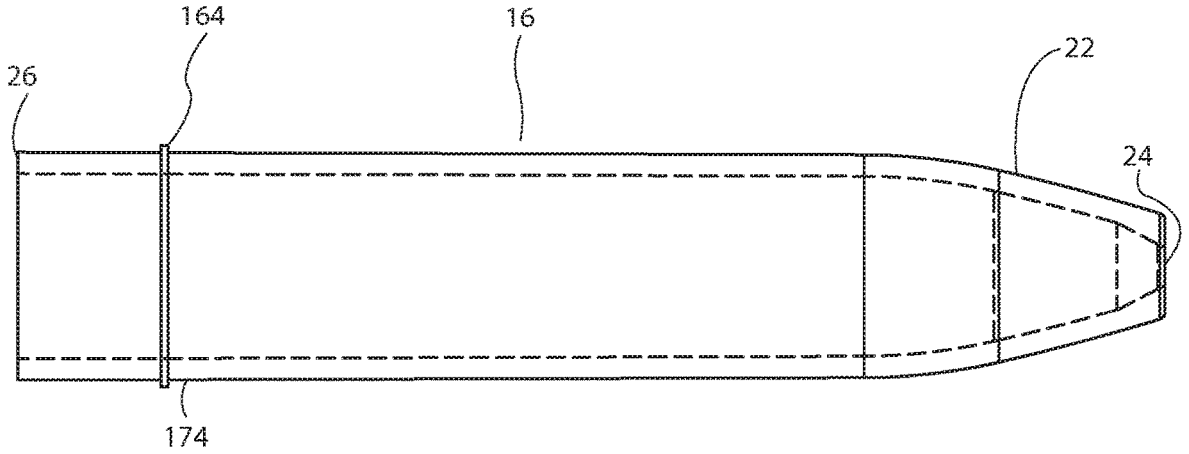
FIG. 13 is side view of the barrel of the multi-pencil of the present invention.
Figure 14:
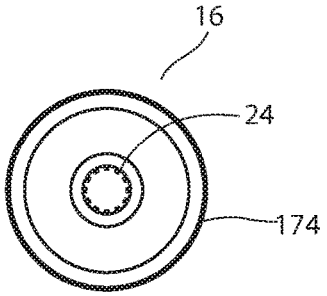
FIG. 14 is a left end view of the barrel of the multi-pencil of the present invention.
Figure 15:
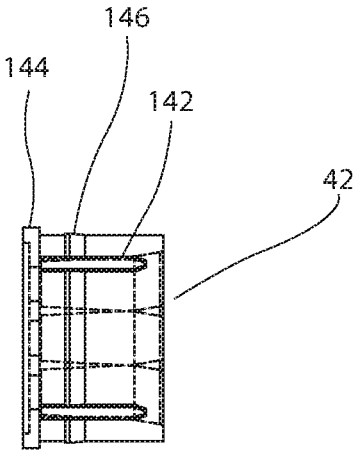
FIG. 15 is side view of the guide plug of the multi-pencil of the present invention.
Figure 16:
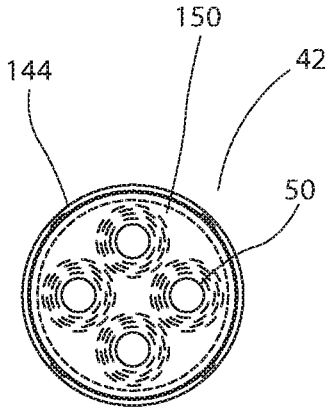
FIG. 16 is a top view of the guide plug of the multi-pencil of the present invention.
Figure 17:
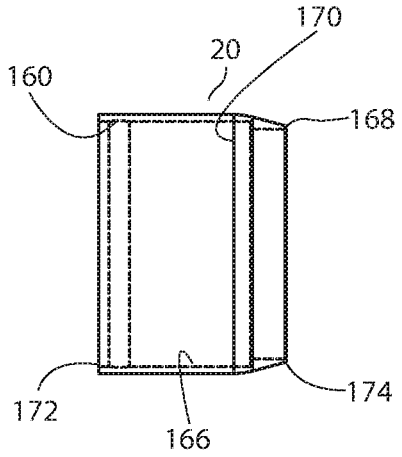
FIG. 17 is side view of the mid-body of the multi-pencil of the present invention.
Figure 18:
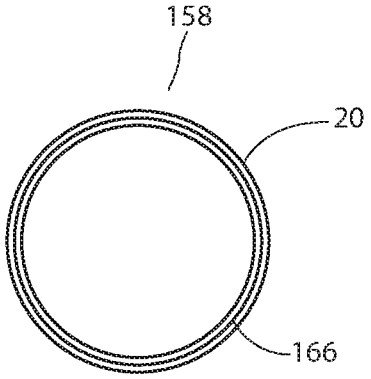
FIG. 18 is a bottom view of the mid-body of the multi-pencil of the present invention.
Figure 19:
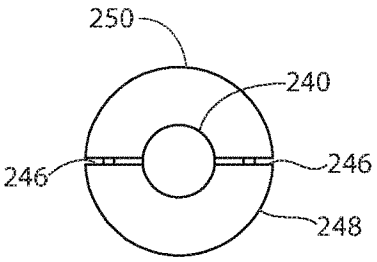
FIG. 19 is side view of the movable sleeve of the present invention.
Figure 20:
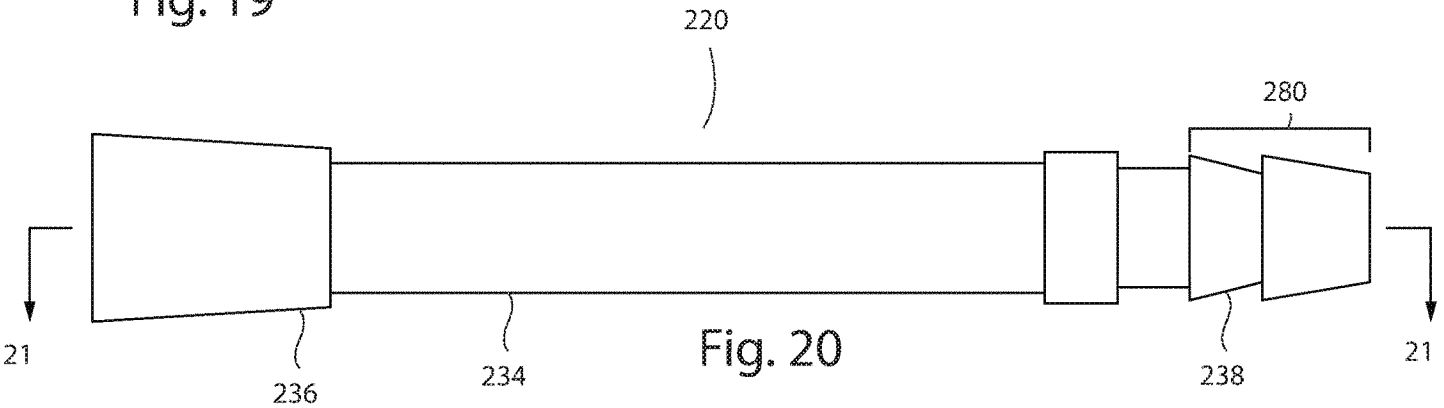
FIG. 20 is a front view of the movable sleeve of the multi-pencil of the present invention.
Figure 21:
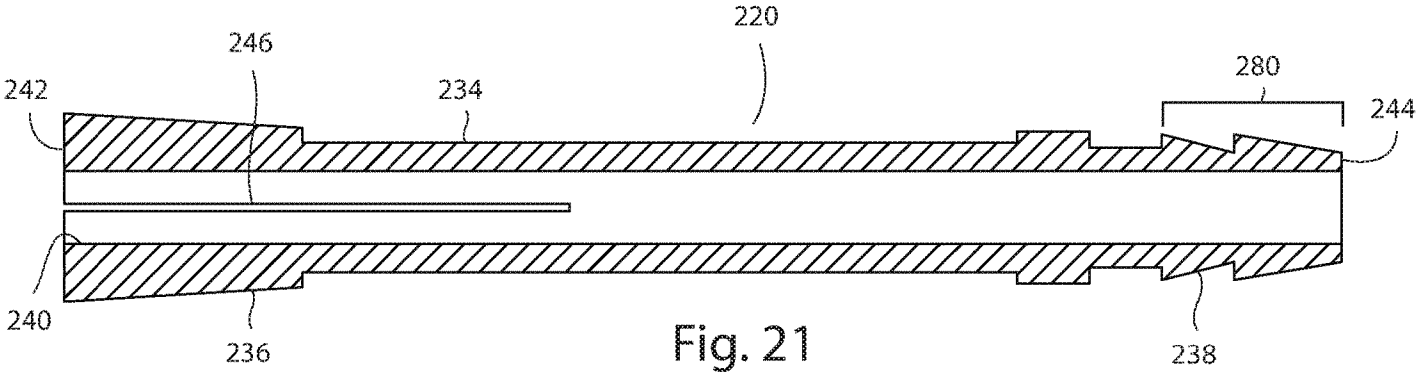
FIG. 21 is a sectional view taken along the line 21-21 of FIG. 20 of the movable sleeve of the multi-pencil of the present invention.
Figure 22:
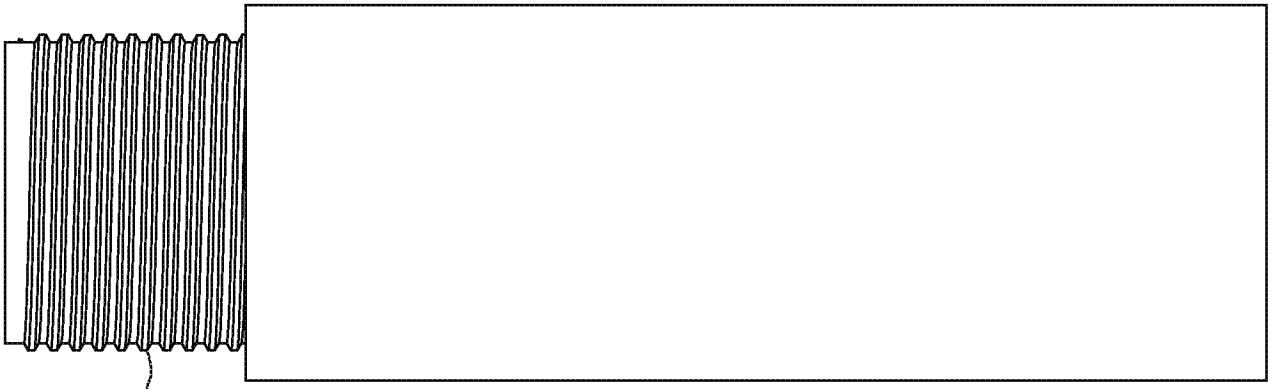
FIG. 22 is side view of the spring retainer of the multi-pencil of the present invention.
Figure 23:
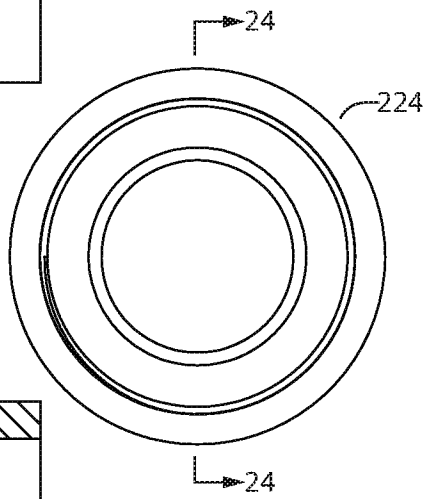
FIG. 23 is a bottom view of the spring retainer of the multi-pencil of the present invention.

Referring now to FIGS. 10-12, a more detailed view of the main body 18 is shown. The main body includes the lower (aft) cylindrical portion 28 and the upper (forward) portion 30. The upper (forward) portion 30 includes four slots 44 spaced equidistant about the perimeter of the main body 18. Each slot 44 has a first end wall 130 and a second end wall 132. Located within each slot 44 is an upper pair of angled upper surfaces 128 and a pair of lower ledges 126 (see FIG. 12). The lower ledges 126 extend from side walls 134 of the slot 44 and which run in an axial direction partially along the length of the slot 44. The lower ledges 126 terminate forward of the second end wall 132 of the slot 44 at ledge end point 152. The upper angled surfaces 128 and lower ledges 126 form a guide channel 134.

With reference to FIG. 5, in an assembled and at rest state, the guides 116 of the slide members 46 are engaged within the guide channels 134. The slide member return springs 52 bias the slide members 46 axially upwards (forwards) such that the catches 136 of the slide member 46 abut the end wall 130 of the slot 44 of the main body 18.

With reference to FIG. 4, when a slide member 46 is actuated, the finger tab 112 of a particular slide member, for example 46A, is pressed axially downward (aft) by a user such that such that the guide 116 slides out of the channel 134 at which point the user's finger pressure biases the finger tab 112 radially inwardly such that the catches 136 of the slide member 46A engage the end points 152 of the lower ledges 126 of the main body 18 and therein hold the slide member 46A in place in a depressed position during use of the cartridge assembly 210 connected to the slide member 46A.

To release the depressed slide member 46A, a user depresses another particular slide member 46B axially downward (aft). Downwards movement causes the striker 114 of the newly depressed slide member 46B to engage the rear angled surface 120 of the already depressed slide member 46A. Such engagement causes the catches 136 of the already depressed slide member 46A to be driven radially outwardly and off the end points 152 of the lower ledges 126 of the main body 18, thereby releasing the depressed slide member 46A. Once released, the depressed slide member 46A is returned to the at rest position by the slide member return spring 52. Upon the continued application of axially downwards finger pressure, the slide member 46B continues to move downward until the guides 114 move out of the channel 134 and the catches 136 of the slide member 46B engage the end points 152 of the lower ledges 126.

In FIG. 4, particular slide member 46A and particular slide member 46B are oriented radially 180 degrees apart. In this orientation, striker 114 of slide member 46B engages the rear angled surface 120 of slide member 46A. However, particular slide members 46A and 46B may also be oriented radially at a 90 degree angle. In this case, if slide member 46A is depressed, subsequent depression of slide member 46B will cause the striker 114 of slide member 46B to contact one of the two mutually opposed angled side surfaces 122 (see FIGS. 7-9), which also has the effect of driving the depressed slide member 46A radially outwardly causing the catches 136 to disengage from the end points 152 of the lower ledges 126 and thereby release the slide member 46A.

Assembly of the Multi-Pencil of the Present Invention

The multi-pencil 10 of the present invention requires no mechanical fasteners or adhesives to assemble. Rather, the multi-pencil 10 may be assembled by means of snap fit components. With reference to FIGS. 5-14, to assemble the multi-pencil 10, the main body 18 is inverted and loaded from the open end with four of the slide assemblies 46, i.e. the guides 116 of each slide assembly 46 are engaged with one of the four channels 134 of the main body 18 and slid into the main body 18 until the catches 136 of the slide member 46 abut the second end wall 132. Next a slide member return spring 52 is placed about the operating rod 48 of each slide member 46.

Next, protrusions 142 of the guide plug 42 are aligned with grooves 138 formed in the main body 18. The guide plug 42 is pressed into the main body 18 until an annular convex surface 146 of the guide plug 42 engages an annular concave surface 148 formed in the main body 18. Upon engagement of annular convex surface 146 with annular concave surface 148, annular rim 144 of the guide plug will rest within annular groove 140 of the main body 18. This completes the assembly of the components housed with the main body 18.

With reference to FIGS. 5-16, subsequently, a cartridge assembly 210 is attached to a ball end 154 of each of the operating rod 48 of the slide member 46. The ball end 154 of the operating rod is configured to engage with the socket 216 at the forward end 214 of the engaging sleeve 212 of the cartridge assembly 210. Next, the barrel 16 is slid through a rear end 172 of the mid-body 20 and out a front end 168 of the mid-body 20. The barrel 16 is pressed or pulled through the mid-body 20 until an annular protrusion 164 of the barrel 16 is seated on an annular shelf 170 of the mid-body 20. The annular protrusion 164 of the barrel 16 is configured to be an interference fit with an inside diameter 166 of the mid-body 20. Next, a main body biasing spring 36 is slid over open upper end 26 of the barrel 16 such that the main body biasing spring is retained between the outside diameter 174 of the barrel and the inside diameter 166 of the mid-body 20. Subsequently, the rear end 172 of the mid-body 20 is slid over a front end 180 of the main body 18. The mid-body 20 is pressed onto the main body 18 until an annular protrusion or concave surface 182 of the main body 18 engages an annular groove or convex surface 160 of the mid-body 20. This completes the assembly of the principle components of the multi-pencil 10.

The component parts of the multi-pencil 10 and cartridge assembly 210 will typically be made from plastic and a variety of polymer formulations are suitable. Certain components such as the tapered, hollow cylindrical sleeve 232 and the biasing springs will typically me made from metallic materials.

While the present invention has been described with regards to particular embodiments, it is recognized that additional variations of the present invention may be devised without departing from the inventive concept.

What is claimed is:

1. A multi-pencil, comprising:

a main body having a closed forward end and an open aft end;

a barrel having an open forward end and a tapered aft end, wherein the tapered aft end terminates in an aperture;

the main body and the barrel configured such that the forward end of the barrel is slideably received within the aft end of main body;

a plurality of cartridges movably retained within the barrel, each of the plurality of cartridges containing a drawing material and each cartridge configured to extrude the drawing material;

a plurality of cartridge selectors, each of the plurality of cartridge selectors connected to one of the plurality of cartridges, each of the plurality of cartridge selectors is movable between a retracted position and a depressed position;

wherein each cartridge of the plurality of cartridges comprises a material holder with a pushing rod slidably disposed therein; and, a movable sleeve slibably coupled with the pushing rod and having means for engaging and disengaging the pushing rod;

wherein the means for engaging and disengaging the pushing rod is a tapered portion of the movable sleeve, wherein the tapered portion is divided into a first half and a second half;

wherein the first half and the second half are inwardly deflectable to engage the pushing rod in response to an applied force and disengage the pushing rod upon relief of the applied force;

wherein the movable sleeve moves aft in response to aft movement of the cartridge selector;

wherein when the movable sleeve is engaged with the pushing rod, the pushing rod moves aft in response to aft movement of the movable sleeve;

wherein when the movable sleeve is disengaged from pushing rod, the pushing rod is stationary in response to forward movement of the movable sleeve;

wherein, when one arbitrary cartridge selector out of the plurality of cartridge selectors is in the retracted position, the connected cartridge is retained inside the barrel and when the arbitrary cartridge selector is moved to the depressed position, an aft end of the material holder of the connected cartridge protrudes from the aperture in the barrel;

wherein, when the arbitrary cartridge selector is in the depressed position, aft movement of the main body causes the cartridge selector to move the movable sleeve of the connected cartridge aft causing the movable sleeve to engage and move the pushing rod aft thereby moving the drawing material aft within the material holder; and, wherein subsequent forward movement of the main body causes the movable sleeve to move forward while the pushing rod remains stationary.

2. The multi-pencil of claim 1, wherein the first half and the second half are slidably disposed within a tapered sleeve, wherein a biasing spring is configured to bias the first half and the second half forward against the tapered sleeve causing a force to be applied to the first half and the second half deflecting the first half and the second half inwardly to engage the pushing rod.

3. The multi-pencil of claim 1, wherein aft movement of the movable sleeve causes the pushing rod and the tapered sleeve to move aft until the tapered sleeve abuts a stop preventing additional aft movement of the tapered sleeve, thereby causing the first half and the second half to separate from the tapered sleeve and disengage from the pushing rod, stopping further aft movement of the pushing rod.

4. The multi-pencil of claim 1, wherein the barrel and main body are interconnected by a mid-body, wherein the mid-body is configured with a biasing spring which biases the main body axially away from the barrel.

5. The multi-pencil of claim 1, wherein the connection between each of the plurality of cartridge selectors and each of the plurality of cartridges is configured to allow each of the plurality of cartridges to deflect radially inwardly.

6. The multi-pencil of claim 1, wherein each cartridge selector includes a ball end surrounded by flexible fingers which engages a socket in an engaging sleeve of each associated cartridge assembly, which allows the cartridge assembly to move angularly with respect to the cartridge selector.

7. The multi-pencil of claim 1, further including a guide within the main body wherein the guide includes a plurality of holes, each hole corresponding to one of the plurality of cartridge selectors, wherein the guide positions the plurality of cartridge selectors about the inside perimeter of the main body.

8. A multi-pencil, comprising:

a main body having an open aft end;

a leading body having an open forward end and an aft end terminating in an aperture;

the main body and the leading body configured such that the leading body is partially disposed and slideably received within the main body;

at least one cartridge having an aft end and a forward end, movably retained within the leading body, the at least one cartridge containing a drawing material dispensable from the aft end of the cartridge;

at least one cartridge selector connected to the at least one cartridge and configured to slide between a retracted position and a depressed position;

wherein the at least one cartridge comprises a material holder with a pushing rod slidably disposed therein, and, a movable sleeve slidably coupled with the pushing rod and having means for engaging and disengaging the pushing rod;

wherein the movable sleeve moves aft in response to aft movement of the cartridge selector and moves forward in response to forward movement of the cartridge selector;

wherein when the movable sleeve is engaged with the pushing rod, the pushing rod moves aft in response to aft movement of the movable sleeve;

wherein when the movable sleeve is disengaged from pushing rod, the pushing rod is stationary in response to forward movement of the movable sleeve;

wherein, when the at least one cartridge selector is in the retracted position, the connected at least one cartridge is retained inside the barrel leading body and when the at least one cartridge selector is moved to the depressed position, an aft end of the material holder of the connected cartridge protrudes from the aperture in the barrel leading body;

wherein, when the at least one cartridge selector is in the depressed position, aft movement of the main body causes the at least one cartridge selector to move the movable sleeve of the connected at least one cartridge aft causing the movable sleeve to engage and move the pushing rod aft thereby advancing the drawing material aft within the material holder; and, wherein subsequent forward movement of the main body causes the movable sleeve to move forward while the pushing rod remains stationary.

9. The multi-pencil of claim 8, wherein the means for engaging and disengaging the material pushing rod is a tapered portion of the movable sleeve, wherein the tapered portion is divided into a first half and a second half, wherein the first half and the second half are inwardly deflectable to engage the pushing rod.

10. The multi-pencil of claim 9, wherein the first half and the second half are slidably disposed within a tapered sleeve, wherein a biasing spring is configured to bias the first half and the second half forward against the tapered sleeve causing the first half and the second half to deflect inwardly and engage the pushing rod.

11. The multi-pencil of claim 10, wherein aft movement of the movable sleeve causes the pushing rod and the tapered sleeve to move aft until the tapered sleeve abuts a stop element preventing additional aft movement of the tapered sleeve, such that continued aft movement of the movable sleeve causes the tapered sleeve to disengage from pushing rod, which stops further aft movement of the pushing rod.

12. The multi-pencil of claim 8, wherein the leading body has a cylindrical forward portion and a tapered aft portion terminating in the exit aperture.

13. The multi-pencil of claim 8, wherein the connection between the at least one cartridge selector and the at least one cartridge is configured to allow the at least one cartridge to deflect radially inwardly.

14. The multi-pencil of claim 8, wherein the cartridge selector includes a ball end surrounded by flexible fingers which engages a socket the cartridge assembly, which allows the cartridge assembly to move angularly with respect to the cartridge selector.

15. The multi-pencil of claim 8, wherein the barrel and leading body are interconnected by a mid-body, wherein the mid-body is configured with a biasing spring which biases the main body axially away from the leading body.

16. A multi-pencil, comprising:

a main body having at least one slot;

a leading body having an aft end terminating in an aperture;

the main body and the leading body configured such that leading body is partially disposed and slideably received within the main body;

at least one cartridge movably retained within the leading body, the at least one cartridge containing a drawing material dispensable from an open end of the cartridge;

at least one cartridge selector connected to the at least one cartridge and configured to slide within the at least one slot in the main body between a retracted position and a depressed position;

wherein, when the at least one cartridge selector is in the retracted position, the at least one cartridge is retained inside the leading body and when the at least one cartridge selector is moved to the depressed position, the at least one cartridge moves such that the open end of the cartridge protrudes from the aperture in the leading body;

wherein, when the at least one cartridge selector is in the depressed position and the first end of the at least one cartridge protrudes from the aperture of the leading body, movement of the main body towards the leading body causes the cartridge to extrude drawing material, and wherein the main body and leading body are interconnected by a mid-body, wherein the mid-body is configured with a biasing spring which biases the main body axially away from the leading body.

17. The multi-pencil of claim 16, wherein the at least one cartridge comprises a material holder, a movable sleeve, a pushing rod, and drawing material;

wherein the pushing rod is slidably disposed within the material holder;

wherein the movable sleeve is movable forward and aft and is slibably coupled with the pushing rod and has means for engaging and disengaging the pushing rod;

wherein the means for engaging and disengaging the pushing rod is a tapered, cylindrical portion, divided into a first half and a second half, wherein the first half and the second half are configured about the pushing rod;

wherein the first half and the second half deflect inwardly to engage the pushing rod in response to an engaging means and disengage the material pushing rod upon relief of the engaging means;

wherein when the movable sleeve moves aft, the movable sleeve engages the pushing rod and moves the pushing rod aft;

wherein when the movable sleeve moves forward, the movable sleeve disengages from the pushing rod and pushing rod remains stationary;

and wherein the drawing material is disposed within the material holder and is advanced aft within the material holder when the movable sleeve moves aft.

18. The multi-pencil of claim 17, wherein the engagement means comprises a tapered sleeve and a biasing spring, wherein the first half and the second half are slidably disposed within the tapered sleeve and the biasing spring is configured to bias the first half and the second half forward against the tapered sleeve causing the first half and the second half to deflect inwardly and engage the pushing rod.

19. The multi-pencil of claim 18, wherein aft movement of the movable sleeve causes the pushing rod and the tapered sleeve to move aft until the tapered sleeve abuts a stop preventing additional aft movement, wherein continued aft movement causes the first half and the second half to separate from the tapered sleeve and thereby disengage from the pushing rod, stopping further aft movement of the pushing rod.

20. The multi-pencil of claim 16, wherein the leading body has a cylindrical forward portion and a tapered aft portion terminating in the exit aperture.

21. The multi-pencil of claim 16, wherein the connection between the at least one cartridge selector and the at least one cartridge is configured to allow the at least one cartridge to deflect radially inwardly.

22. The multi-pencil of claim 16, wherein the cartridge selector includes a ball end surrounded by flexible fingers which engages a socket in a sleeve of the cartridge assembly, which allows the cartridge assembly to move angularly with respect to the cartridge selector.

23. The multi-pencil of claim 16, further including a guide within the main body wherein the guide includes at least one hole for controlling the location of the at least one cartridge selector within the main body.

* * * * *